US007448105B2

(12) United States Patent
Buckwitz et al.

(10) Patent No.: US 7,448,105 B2
(45) Date of Patent: Nov. 11, 2008

(54) PNEUMATIC CLEANING METHODS AND SYSTEMS

(75) Inventors: Richard J. Buckwitz, Issaquah, WA (US); Peter D. McCowin, Enumclaw, WA (US); Mark R. Weber, Seattle, WA (US)

(73) Assignee: The Boeing Company, Chicago, IL (US)

( * ) Notice: Subject to any disclaimer, the term of this patent is extended or adjusted under 35 U.S.C. 154(b) by 709 days.

(21) Appl. No.: 10/893,913

(22) Filed: Jul. 20, 2004

(65) Prior Publication Data

US 2006/0016461 A1 Jan. 26, 2006

(51) Int. Cl.
*B08B 9/053* (2006.01)

(52) U.S. Cl. ..... 15/3.5; 15/3.51

(58) Field of Classification Search ..... 15/3.5, 15/3.51, 104.062; 134/22.1, 22.11, 22.12, 134/26, 30

See application file for complete search history.

(56) References Cited

U.S. PATENT DOCUMENTS

| | | | | | |
|---|---|---|---|---|---|
| 3,366,337 | A | * | 1/1968 | Brooks et al. | 239/414 |
| 3,631,555 | A | * | 1/1972 | Hurst et al. | 15/3.5 |
| 4,252,255 | A | * | 2/1981 | Henderson | 222/135 |
| 4,467,488 | A | * | 8/1984 | Creek | 15/3.5 |
| 5,555,585 | A | * | 9/1996 | Fowler | 15/3.5 |
| 2002/0124871 | A1 | | 9/2002 | Rinne | |

* cited by examiner

*Primary Examiner*—Laura C Guidotti
(74) *Attorney, Agent, or Firm*—Baker Hostetler LLP

(57) ABSTRACT

Techniques for cleaning the inside of complexly-bent tubing are disclosed using a combination of minimal amounts of solvent and pneumatically propelled foam pellets. In order to increase device efficiency, an escapement apparatus employs a vacuum-assisted loading mechanism and retaining pin to reliably load one pellet at a time.

6 Claims, 12 Drawing Sheets

PNEUMATIC CLEANING METHODS AND SYSTEMS

FIELD OF THE INVENTION

This invention relates to methods and systems for cleaning tube-like structures.

BACKGROUND OF THE INVENTION

The construction of a large and complex system, such as an aircraft or automobile, generally requires the manufacture of thousands of components and sub-components. For example, a particular aircraft will require the assembly and installation of a number of hydraulic systems to manipulate the aircraft's control surfaces, and the hydraulic systems will require the manufacture of shaped tubing to transport hydraulic fluid across the various components of the control systems.

It should be appreciated that the manufacture of even the simplest of components can require a large number of steps, and that one of the final steps before integration into a larger assemble can involve cleaning. For instance, using the hydraulic tubing example above, it can be desirable to remove organic and inorganic contaminates from the inside of the tubing before installing the tubing into a control system and charging (filling) the control system with hydraulic fluid.

While there are a number of available methods to clean tubing, such as letting the tubing soak for an extended period in a solvent bath, such methods are not economical when only a few pieces of tubing need cleaning at a time, or practical when the tubing needs cleaning in a very short time. Accordingly, new methods and systems for cleaning tubing are desirable.

SUMMARY OF THE INVENTION

One of the many advantages of using some elements of the invention is that it provides an inexpensive and fast approach to cleaning the inside of a given tube-like structure using very little energy and solvent.

For example, an apparatus for cleaning the inner-surface of a tube is described that includes a spraying portion having a connection to a solvent container and configured to apply solvent to the inner-surface of the tube, and a pellet-shooting portion configured to shoot one or more pellets into the tube thus wiping the tube clean of solvent and contaminants.

An escapement apparatus for sequentially launching pellets is also disclosed, the escapement apparatus having an escapement body with an embedded escapement channel, a first shuttle capable of controllably blocking the escapement channel at a first location along the length of the escapement channel, a second shuttle capable of controllably blocking the escapement channel at a second location along the length of the escapement channel and an air-flow assisted means to reliably draw pellets into an escapement chamber defined by the escapement channel and the first and second shuttles.

A method for cleaning the inside of a tube is disclosed that includes injecting a quantity of solvent into the tube, and subsequently injecting one or more pellets into the tube. A method for loading foam pellets into an escapement device is also disclosed that includes attracting a plurality of foam pellets into an escapement chamber using a forced gas flow, and activating a retaining mechanism to prevent all but a first pellet from entering the chamber.

There has thus been outlined, rather broadly, certain embodiments of the invention in order that the detailed description thereof herein may be better understood, and in order that the present contribution to the art may be better appreciated. There are, of course, additional embodiments of the invention that will be described or referred to below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
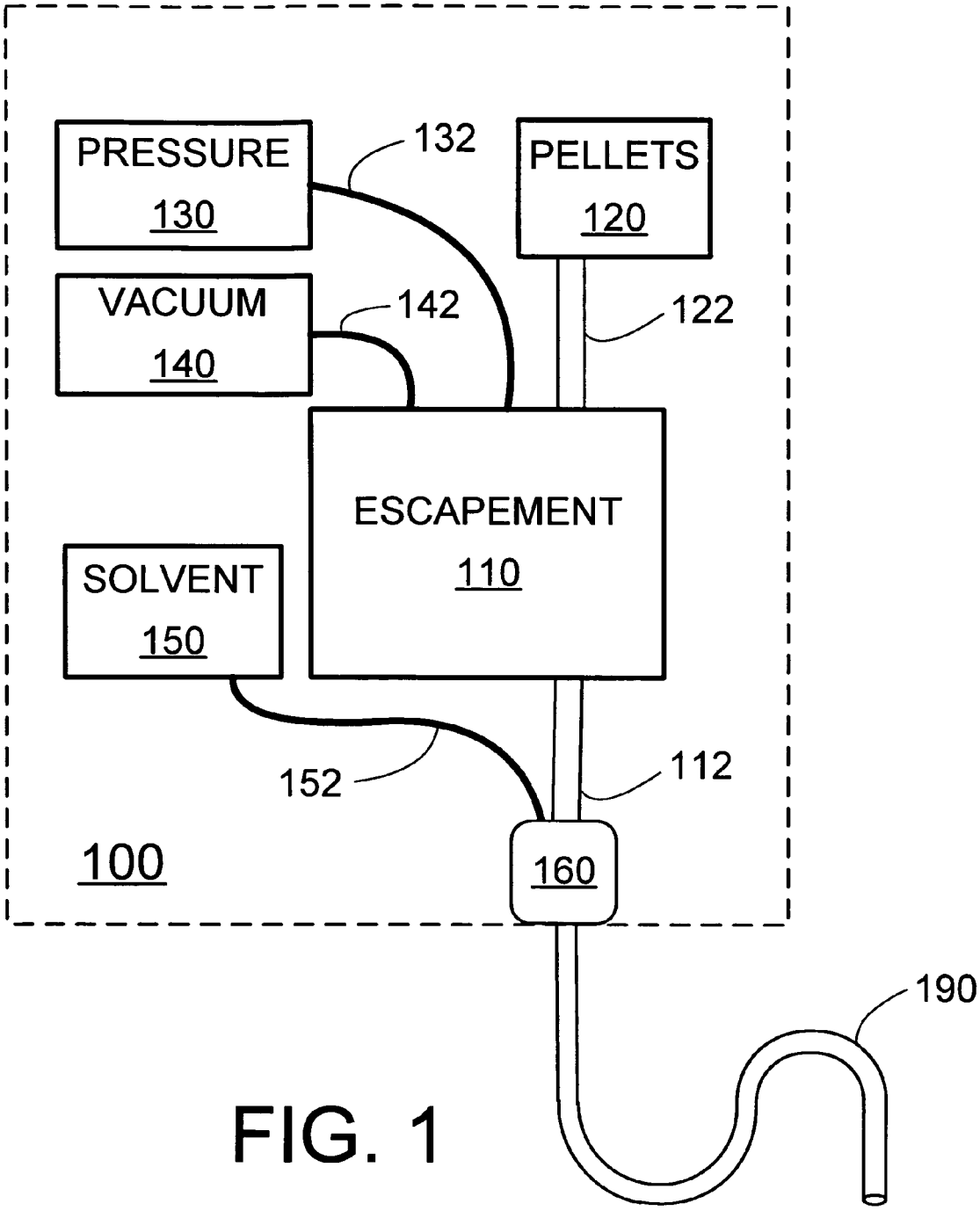
FIG. 1 depicts an exemplary system for cleaning tubes.

The enhancements of the invention(s) permit the cleaning of practically any form of tubing in a short time using very little solvent and energy. FIG. 1 depicts a cleaning system 100 for cleaning the insides of tubing, such as the complexly-bent production tube 190 shown at the bottom right-hand corner.

As shown in FIG. 1, production tube 190 has a complex "S"-shape that would preclude a straightforward cleaning, e.g., forcibly ramming a piece or cloth or brush down the length using a metal rod, as could be done with a straight tube, or soaking the tube in a wasteful amount of solvent solution for an extended period of time. The present system 100 overcomes the shortcomings of prior cleaning approaches by first spraying an appropriate amount of solvent down the length of the production tube 190 (using an optional forced air flow to help move the solvent down the length of the tube) followed by pneumatically propelling a number of foam pellets through the production tube 190 in order remove contaminates and solvent by literally wiping the inside of the tube with the pellets.

As shown in FIG. 1, the cleaning system 100 includes an escapement device 110 and a solvent container 150 coupled to a fitting device 160 via respective hose 112 and solvent tube 152. The escapement device 110 is also coupled to a container of foam pellets 120 via pellet supply tube 122, a pressure source 130 via tube 132 and a vacuum source 140 via tube 142. The pressure source 130 and the vacuum source 140 of the present cleaning system are air pumps. However, it should be appreciated that in other embodiments the pressure source 130 and the vacuum source 140 can take various other forms, such as pneumatic pressure bottles and the like.

In operation, a workman or other operator can attach production tube 190 to the fitting device 160, which in the present embodiment can take the form of a gun-shaped handle capable of making an effective seal with the end of a tube.

Next, the workman can activate a first control (not shown) optionally located on the fitting 160 in order to start the cleaning process. The cleaning process of the present embodiment starts with the release of a proscribed amount of liquid solvent (provided by solvent container 150) through the fitting device 160 and into the tube. In the present embodiment the solvent is delivered as a thin stream of liquid assisted by a forcible air flow (provided by the escapement device 100). However, it should be appreciated that in other embodiments the solvent can be delivered as a stream, a fine mist or in any other advantageous form. Further, while the present embodiment uses forced air flow to aid in the distribution of solvent, it should be appreciated that in various embodiments forced air flow can be replaced by other means, e.g., gravity or added momentum, and even eliminated all together.

Once the solvent is applied and distributed within the production tube 190, the escapement device 110 can retrieve a number of foam pellets one at a time from the pellet container 120 using the vacuum source 140 to aid retrieval, then forcibly propel the foam pellets one at a time using pneumatic pressure provided by the pressure source 130. As each foam pellet is ejected from the escapement device 110, the pellets travel through hose 112 and into the fitting device 160 where they are guided into production tube 190.

As a given foam pellet travels along the length of the production tube 190, it should be appreciated that the pellet will effectively wipe the inside of the tube and absorb contaminates and solvent along the way. Accordingly, it should be appreciated that the solvent serves two purposes: bringing contaminates into solution and acting as a lubricant for the pellets to prevent jamming. Further, it should be appreciated that it can be advantageous for the foam pellets to be formed having "open cells" capable of absorbing the solvent and contaminates, as opposed to having a smooth skin incapable of effectively passing fluids and small particles.

The inventors of the present methods and systems have determined that it is often advantageous to propel more than one pellet in the cleaning process, but that two pellets is very often an effective number. Accordingly, the present cleaning system 100 is configured to automatically propel two pellets after a single application of solvent. However, it should be appreciated that the cleaning system 100 can be configured to eject an amount of solvent between pellets and/or be configured to eject any number of pellets as may be advantageous or desirable.

Figure 2:
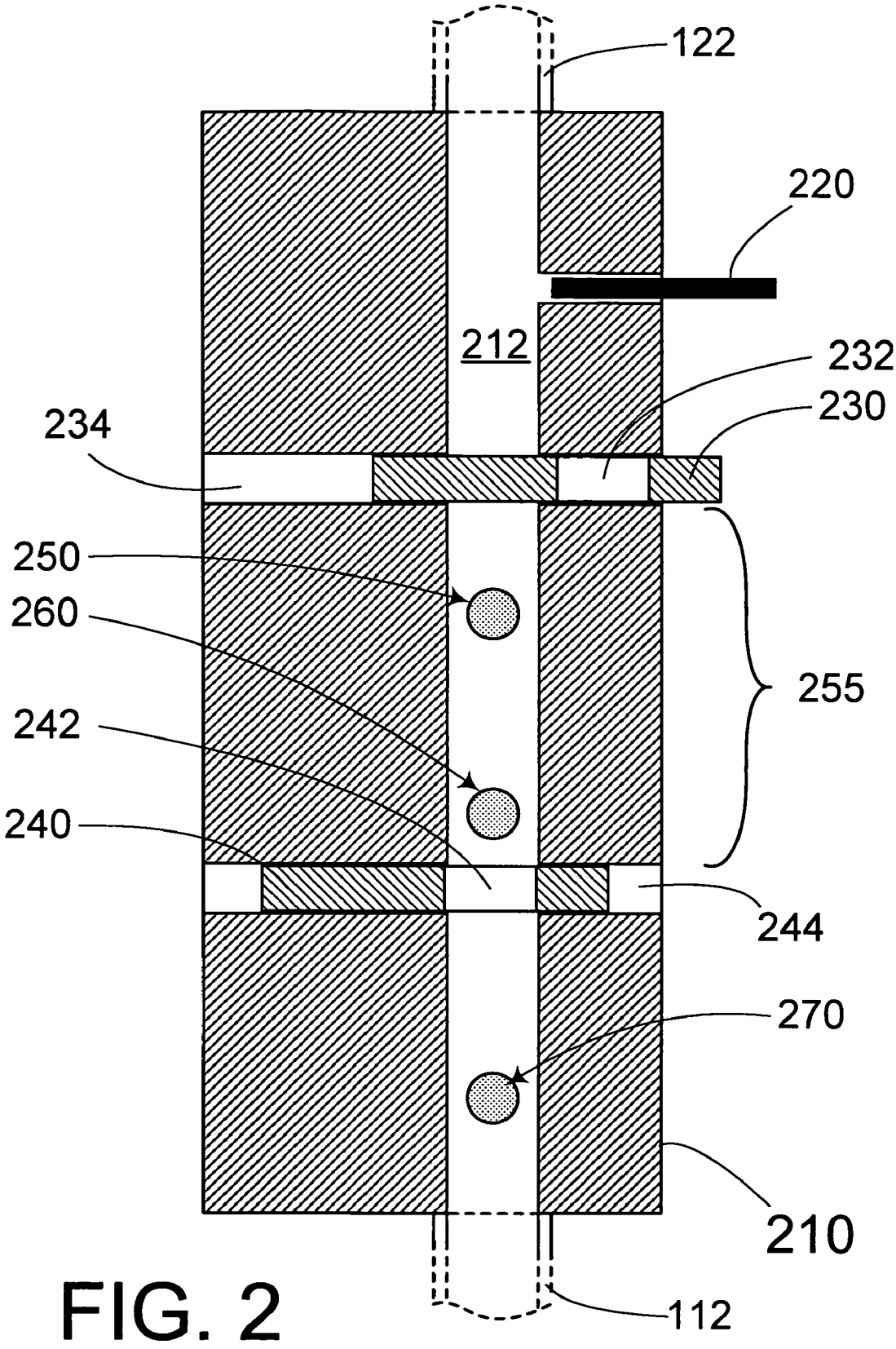
FIG. 2 depicts details of the escapement device of FIG. 1.

FIG. 2 depicts an escapement device 110 capable of use with the cleaning system 100 of FIG. 1 above. As shown in FIG. 2, the escapement device 110 includes an escapement body 210 having an escapement channel 212 running down the length of the body 210, a retaining pin 220 located along the escapement channel 212, a first shuttle 230 moveable within a first shuttle-guide 234 and located below the retaining pin 220, a second shuttle 240 moveable within a second shuttle-guide 244, a first pressurized gas port 250 and a vacuum port 260 located between the two shuttles 230 and 240 and along the escapement channel 212 and a second pressurized gas port 270 located below the second shuttle 240.

In operation, the various components 220-270 can perform separate and distinctive functions. For example, as will be shown the following figures, the shuttles 230 and 240 with their respective holes 232 and 242 can act as switches depending on their particular position within their respective guides 234 and 244. Similarly, the retaining pin 220 can act as a form of switch depending on its particular position within its respective guide. Further, the functionality of ports 250, 260 and 270 will be shown for their capacity to propel or attract pellets, and so on.

Figure 3:
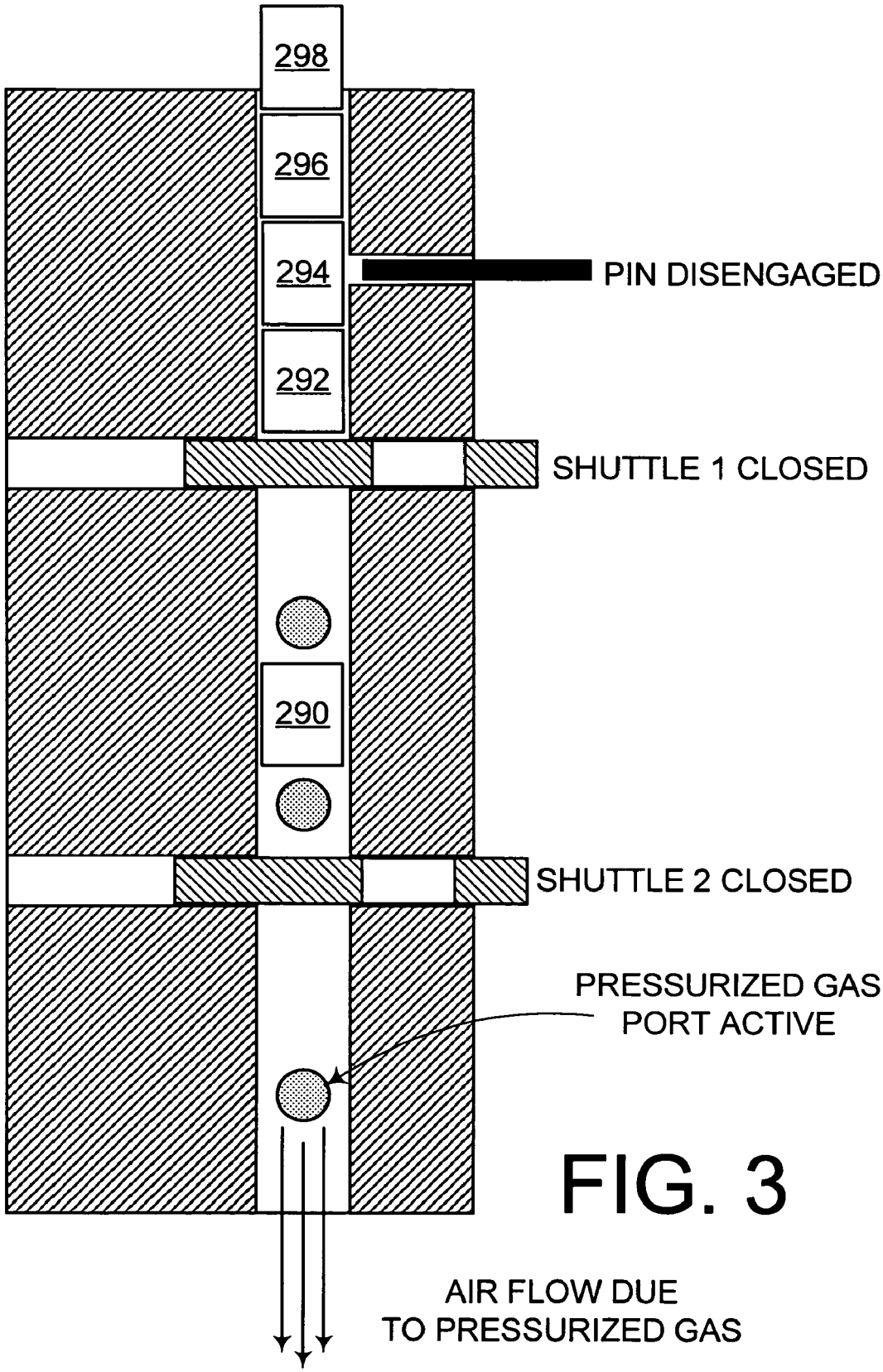
FIG. 3 depict a first step in the operation of the escapement device of FIG. 2.

FIG. 3 depicts the escapement device 110 of FIG. 2 in a first state where the retaining pin 220 is disengaged, the shuttles 230 and 240 are closed, a first pellet 290 in the chamber 255 defined by the shuttles 230 and 240 and the escapement channel 212, a number of other pellets 292-298 are stacked above the first shuttle 230, and the second pressurized gas port 270 is active, i.e., expelling pressurized gas to create an air flow exiting the escapement body 210.

Referring back to FIG. 1, it should be appreciated that the present state of the escapement device is useful for providing an airflow that can be used to help transport a solvent through the length of a tube. That is, as solvent is released into production tube 190 from one end, the air flow created by port 270 can assist the solvent along the length of such tube.

Figure 4:
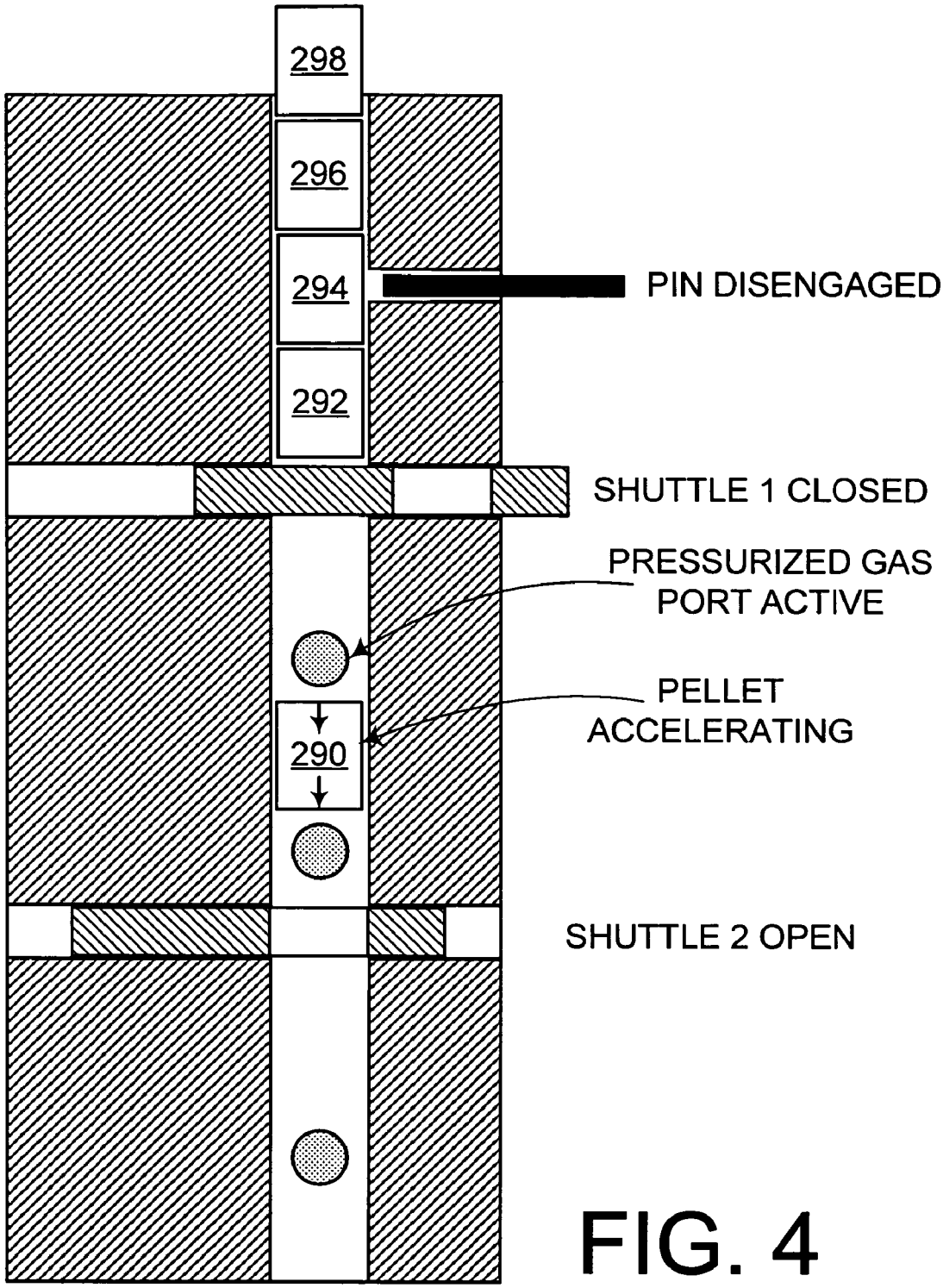
FIG. 4 depict a second step in the operation of the escapement device of FIG. 2.

FIG. 4 depicts the escapement device 110 of FIG. 2 in a second state where the retaining pin 220 is disengaged, the first shuttle 230 is closed, the second shuttle 240 is open, the vacuum port 260 and the second pressurized gas port 270 are inactive and the first pressurized gas port 250 is active, i.e., expelling air. In the present state, the pressure buildup within chamber 255 due to the gas from port 250 can literally propel pellet 290 down through the bottom of the escapement device 110 much as a bullet is propelled from a gun. Referring back to FIG. 1, the present state is useful to propel a pellet through hose 112, fitting 160 and the inside of production tube 190.

Figure 5:
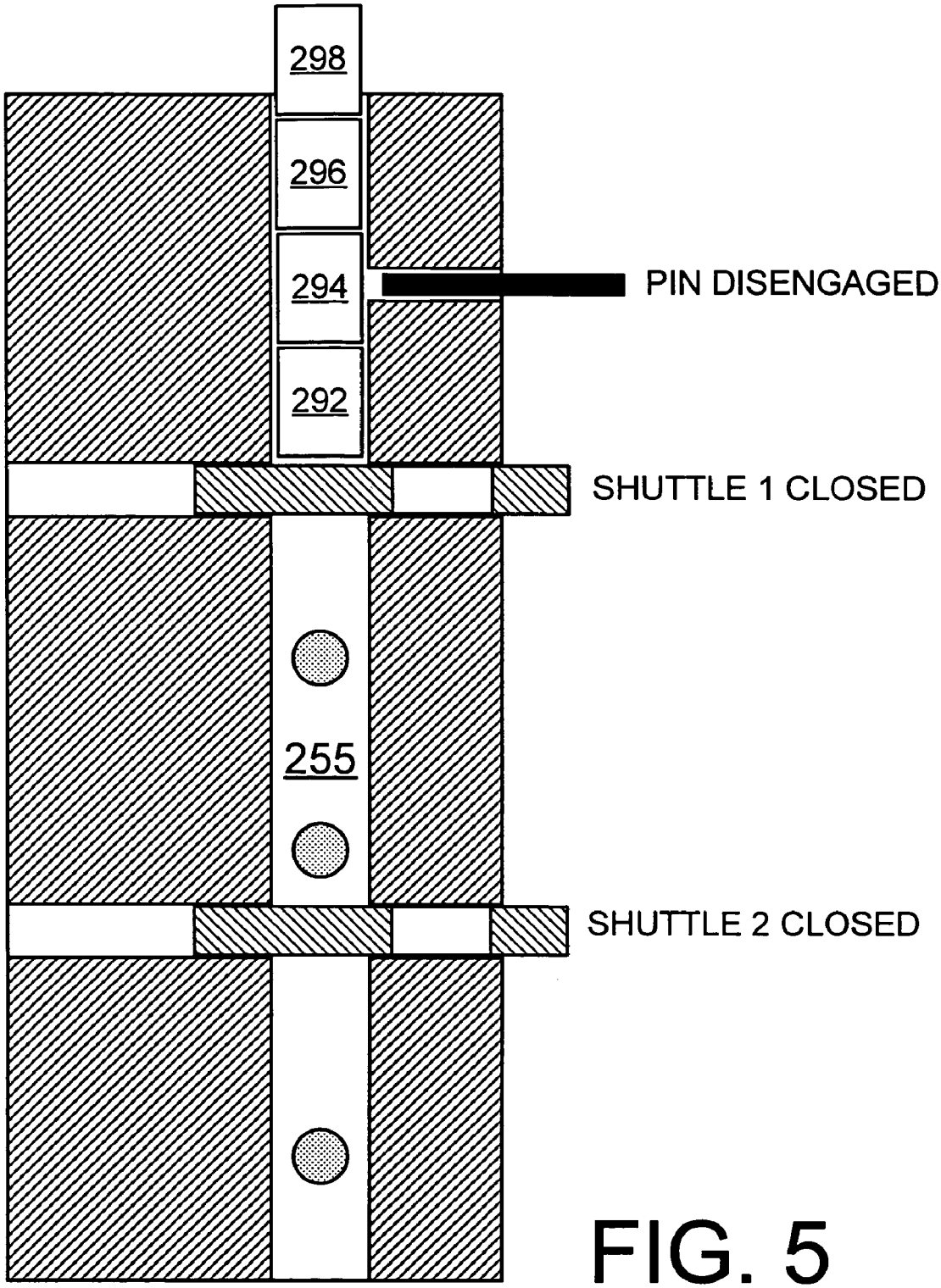
FIG. 5 depict a third step in the operation of the escapement device of FIG. 2.
Figure 6:
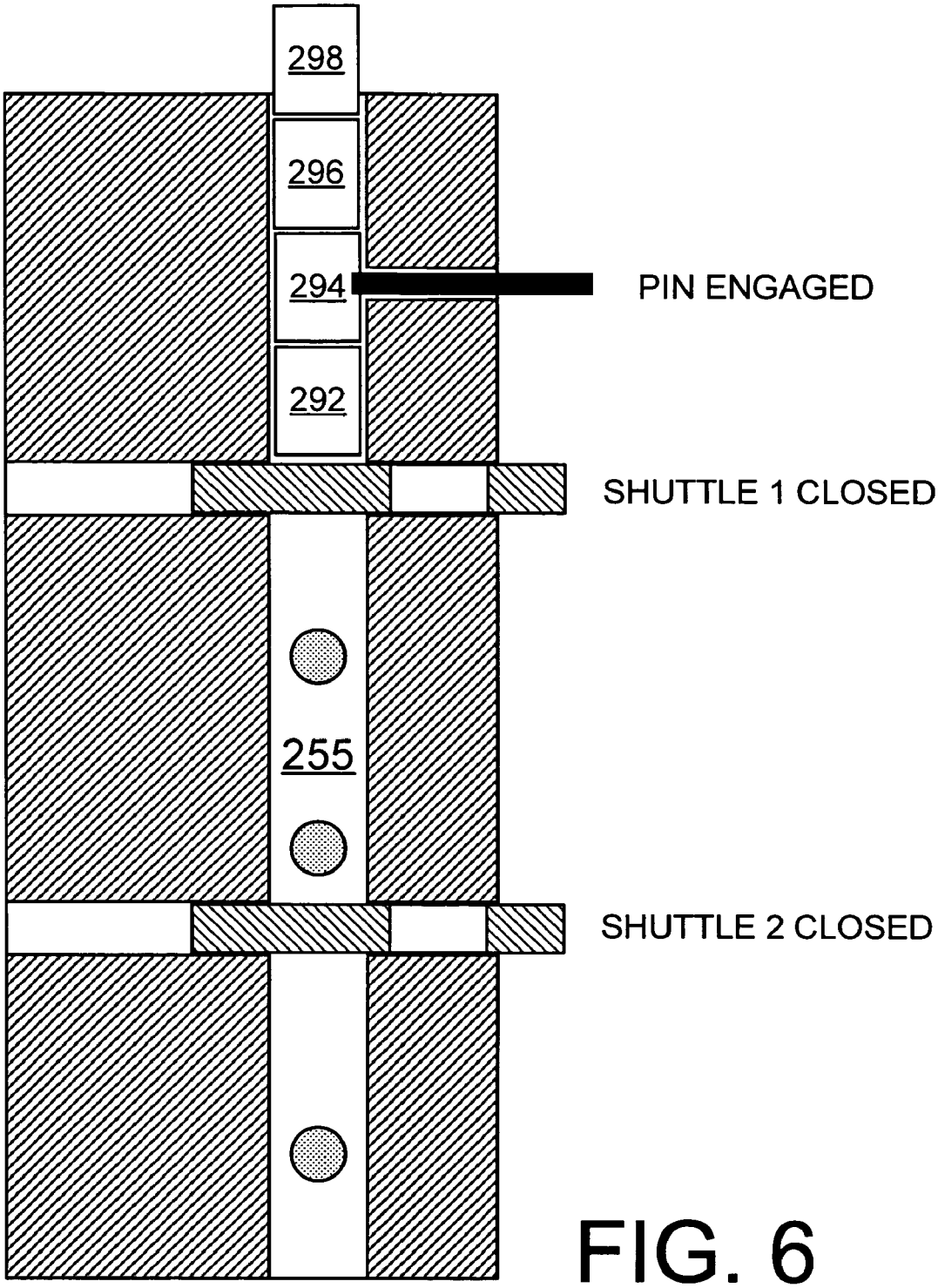
FIG. 6 depict a fourth step in the operation of the escapement device of FIG. 2.

FIGS. 5-9 depict a reloading of the escapement device 110 with FIG. 5 depicting the escapement device 110 of FIG. 2 in a third state where the retaining pin 220 is disengaged, the shuttles 230 and 240 are closed and all ports 250, 260 and 270 are inactive. FIG. 6 depicts the escapement device 110 of FIG. 2 in a fourth state where the retaining pin 220 is engaged, the shuttles 230 and 240 are closed and all ports 250, 260 and 270 are inactive. As shown in FIG. 6, the present state is useful in that the retaining pin 220 can hold pellet 294 in place without encumbering pellet 292.

Figure 7:
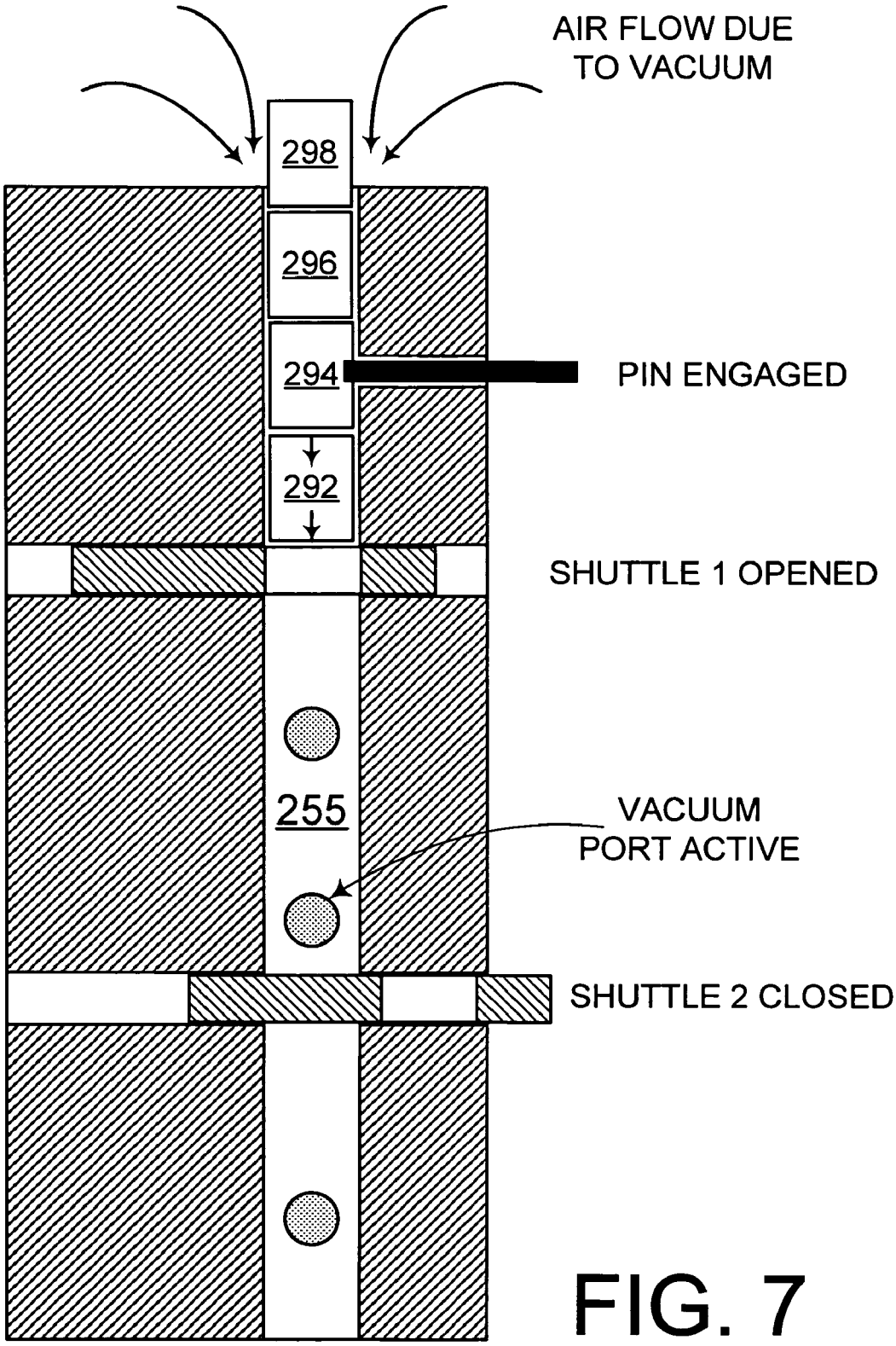
FIG. 7 depict a fifth step in the operation of the escapement device of FIG. 2.

Continuing to FIG. 7, the escapement device 110 is depicted in a fifth state where the retaining pin 220 is engaged, the first shuttle 230 is open, the second shuttle 240 is closed, the pressurized gas ports 250 and 270 are inactive and vacuum port 260 is active. In response to the state depicted in FIG. 7, pellet 292 is drawn into the escapement chamber 255 by virtue of a combination of gravity and a differential pressure/air flow created by the vacuum port 260. Meanwhile, pellets 294, 296 and 298 are precluded from entering the chamber 255 by virtue of the retaining pin's impingement of pellet 294.

While in various embodiments the escapement device could function without using a vacuum port, i.e., by using gravity alone to draw pellets into the escapement chamber 255, the inventors of the disclosed methods and systems have determined experimentally that using an air flow to assist each pellet along greatly increases the reliability of the escapement device 110. Further, while it should be appreciated that the present system uses vacuum port 260 to create differential pressure and air flow, similar results might be attained by using other configurations, such as using a pressurized gas port above the pellets 292-298 to force air (and pellets) into the escapement chamber 255.

Figure 8:
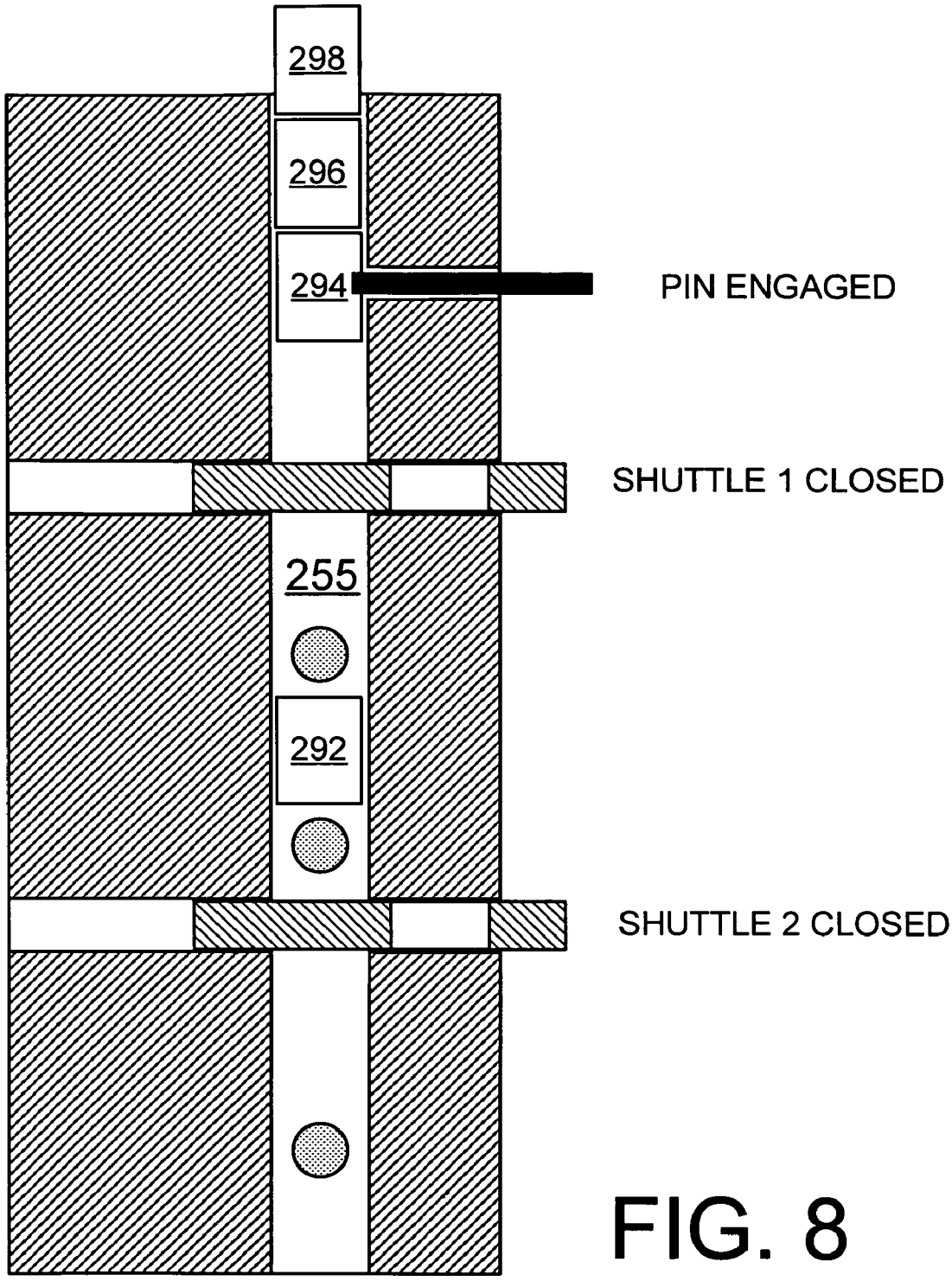
FIG. 8 depict a sixth step in the operation of the escapement device of FIG. 2.
Figure 9:
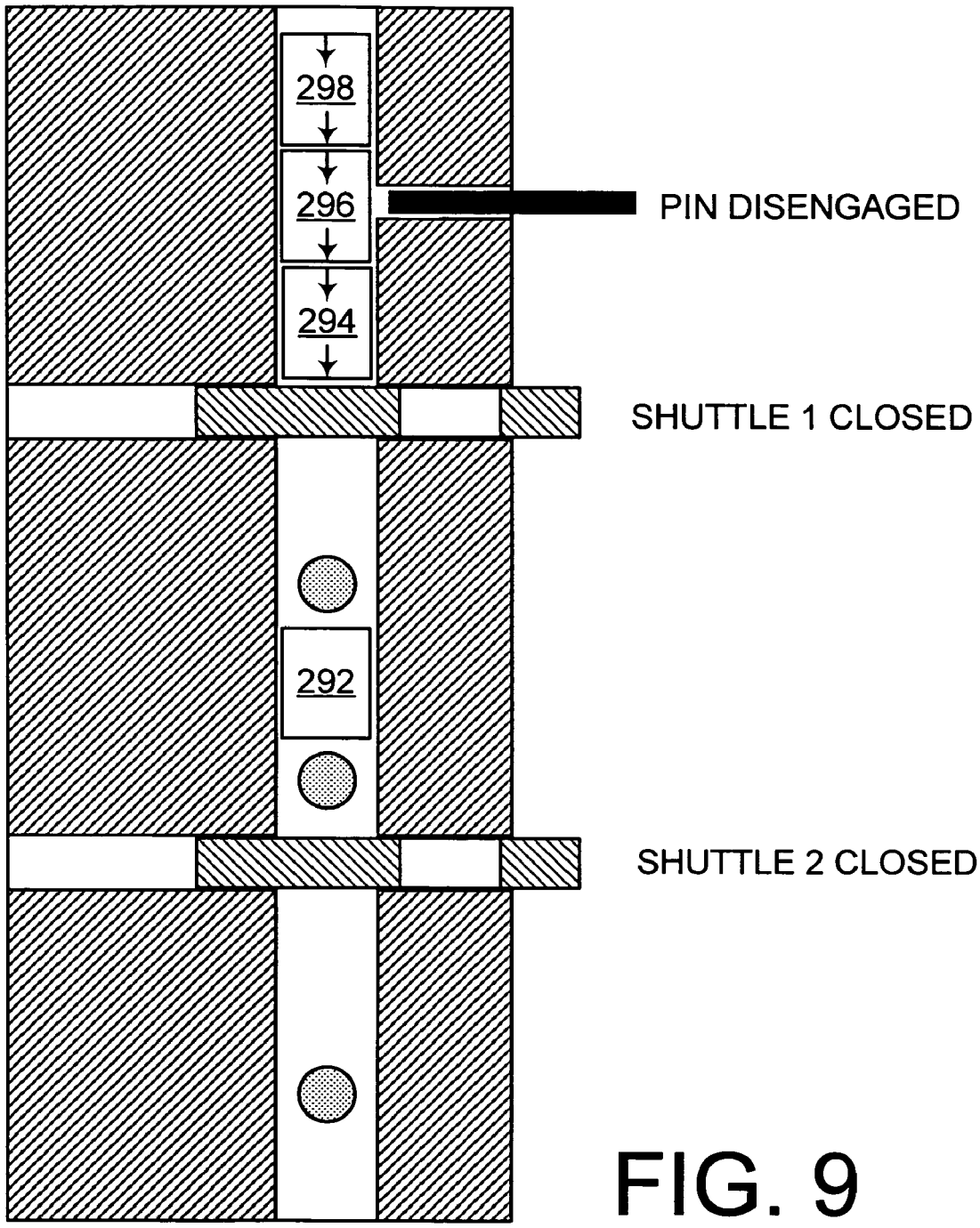
FIG. 9 depict a seventh step in the operation of the escapement device of FIG. 2.

Continuing to FIG. 8, the first shuttle is closed to seal pellet 292 into the escapement chamber 255, and in FIG. 9, the retaining pin 220 is disengaged to allow pellets 294-298 to incrementally drop and to create a state substantially identical to that shown in FIG. 3.

Figure 10:
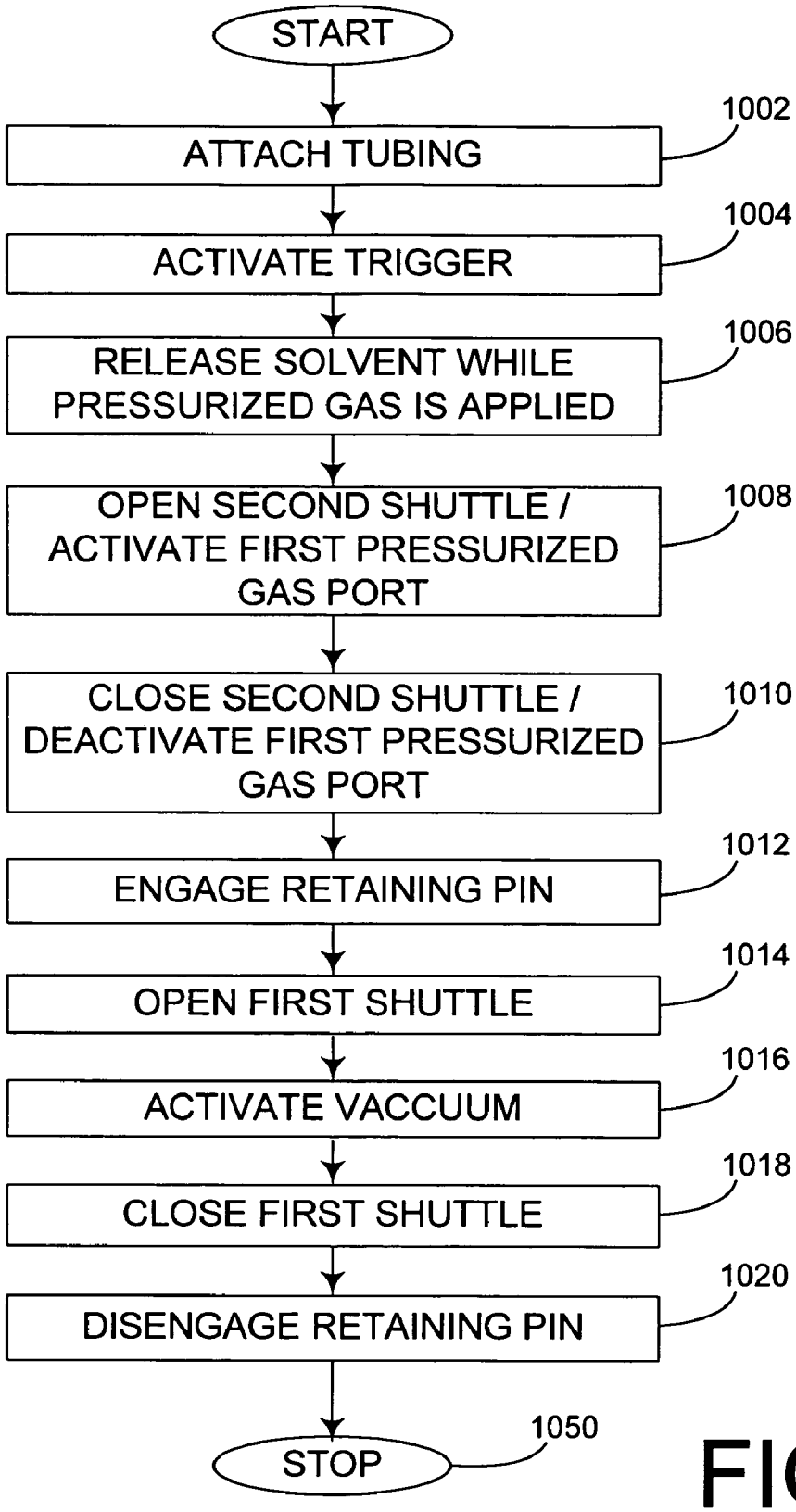
FIG. 10 is a flowchart outlining an exemplary operation according to the present disclosure.

FIG. 10 is a flowchart outlining an exemplary operation for operating a pneumatic tube-cleaning apparatus, such as the cleaning device and components described above. The process starts in step 1002 where a tube to be cleaned is attached to an appropriate fitting of the cleaning device. Next, in step 1004, a workman/operator can activate a trigger to start the cleaning process. Control continues to step 1006.

In step 1006, an amount of solvent is released into the tube with an optional application of pressurized gas to assist the solvent down the length of the tube. Next, in step 1008, an escapement device within the cleaning apparatus can open an appropriate shuttle (switch) and activate a first pressurized gas port (device) in order to pneumatically propel a foam pellet throughout the length of the tubing. Then, in step 1010, the shuttle of step 1008 is closed and the first pressurized gas port is deactivated. Control continues to step 1012.

In step 1012, a retaining pin is engaged to hold fast a given pellet in a stack of pellets. Then, in step 1014, a first shuttle is opened to allow a pellet located between the held pellet of step 1012 and an escapement chamber to fall into the escapement chamber. Then, in step 1016, a vacuum port is activated to help draw the pellet of step 1014 into the escapement chamber. Control continues to step 1018.

In step 1018 the first shuttle is closed. Next, in step 1020 the retaining pin is disengaged. Control then continues to step 1050 where the process stops. While the exemplary flowchart of FIG. 10 describes a single cycle of solvent and pellet application, as discussed above it should be appreciated that steps 1002-1020 can be optionally repeated, or that steps 1008-1020 can be optionally repeated to encompass the use of multiple applications of solvent and/or pellets.

Figure 11:
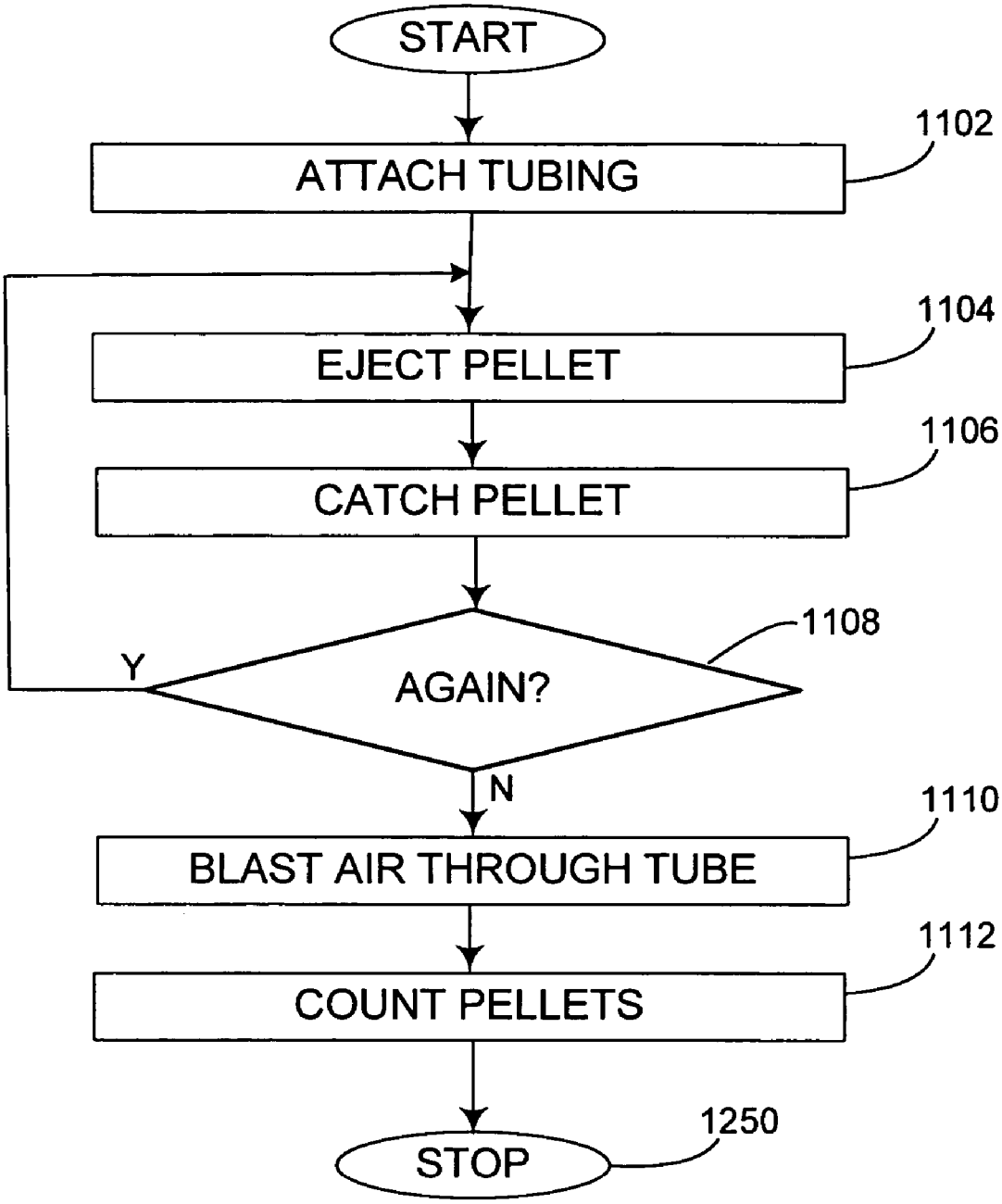
FIG. 11 is a flowchart outlining a second exemplary operation according to the present disclosure.

FIG. 11 is a flowchart outlining a second exemplary operation for operating a pneumatic tube-cleaning apparatus, such as the cleaning device and components described above. The process starts in step 1102 where a tube to be cleaned is attached to an appropriate fitting of the cleaning device. Next, in step 1104, a pellet is ejected into a production tube. Then, in step 1106, the ejected pellet is caught in a catching device, e.g, a mesh bag, so as to safely retain errant high-velocity pellets from injuring nearby people or damaging nearby equipment. Control then continues to step 1108.

In step 1108, a decision is made whether to eject one or more pellets. If more pellets are to be ejected, control jumps back to step 1104; otherwise, control continues to step 1110.

In step 1110. after no more pellets are to be ejected and subsequently caught, a blast of air is forced into the production tube in order to assure that there are no pellets stuck within the tube. Next, in step 1112, an operator can count the pellets in the catching device (the "catcher") in order to assure that all pellets used are accounted for. Control then continues to step 1250 where the process stops.

Figure 12:
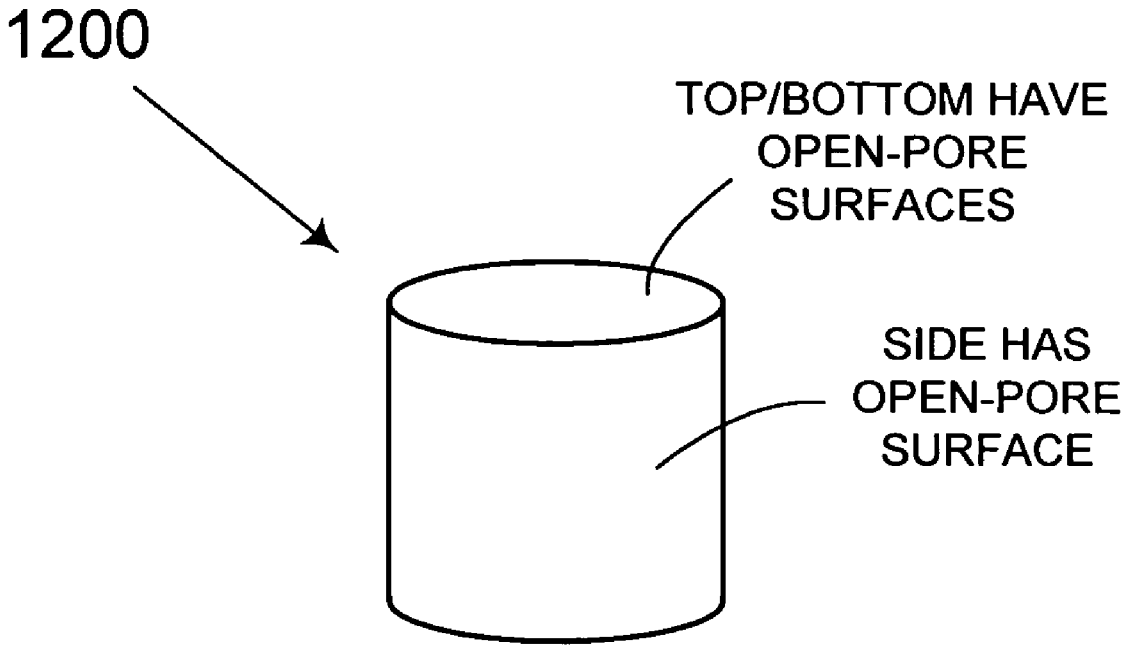
FIG. 12 depicts a foam pellet useable in the disclosed cleaning methods and systems.

FIG. 12 depicts an exemplary foam pellet 1200 useful for cleaning tube-like structures. As shown on FIG. 12, the foam pellet 1200 is generally cylindrically-shaped with a top portion, a bottom portion and a round side. While not specifically shown, all surfaces of the exemplary pellet 1200 have porous surfaces: the advantage to the porous surfaces being its ability to readily absorb solvent and contaminates.

While the exemplary pellet of FIG. 12 is cylindrical, it should be appreciated that the particular shape of a cleaning pellet can vary to encompass any number of useful shaped, such as bullet-like, round etc. Further, while the pellets of the exemplary methods and systems use porous surfaces, other surface types and textures including smooth surfaces, abrasive surfaces etc might also be utilized depending on the particular nature of a cleaning problem.

In various embodiments where the above-described systems and/or methods are implemented using a programmable device, such as a computer-based system or programmable logic, it should be appreciated that the above-described systems and methods can be implemented using any of various known or later developed programming languages, such as "C", "C++", "FORTRAN", Pascal", "VHDL" and the like.

Accordingly, various storage media, such as magnetic computer disks, optical disks, electronic memories and the like, can be prepared that can contain information that can direct a device, such as a computer, to implement the above-described systems and/or methods. Once an appropriate device has access to the information and programs contained on the storage media, the storage media can provide the information and programs to the device, thus enabling the device to perform the above-described systems and/or methods.

For example, if a computer disk containing appropriate materials, such as a source file, an object file, an executable file or the like, were provided to a computer, the computer could receive the information, appropriately configure itself and perform the functions of the various systems and methods outlined in the diagrams and flowcharts above to implement the various functions. That is, the computer could receive various portions of information from the disk relating to different elements of the above-described systems and/or methods, implement the individual systems and/or methods and coordinate the functions of the individual systems and/or methods to clean tubing using the methods and systems described above.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. An apparatus for cleaning the inner-surface of a tube, comprising:

a pellet-shooting portion configured to shoot a pellet into the tube, the pellet-shooting portion comprising:

a first shuttle;

a second shuttle;

a chamber disposed between the first shuttle and the second shuttle;

a vacuum port disposed in the chamber, wherein the pellet is drawn into the chamber in response to the first shuttle being in an open position, the second shuttle being in a closed position and the vacuum port drawing in air; and a first pressurized gas port disposed in the chamber, wherein the pellet is discharged from the chamber in response to the first shuttle being closed, the second shuttle being open, and pressurized air being expelled from the first pressurized gas port; a second pressurized gas port disposed relatively downstream of the chamber; and a supply of solvent fluidly connected relatively downstream of the second pressurized gas port, wherein solvent is sprayed into the tube in response to the second shuttle being in a closed position, a portion of solvent being supplied from the supply of solvent and pressurized air being expelled from the second pressurized gas port.

2. The apparatus of claim 1, wherein the spraying pellet-shooting portion is configured to shoot two pellets down the length of the tube using pressurized gas.

3. The apparatus of claim 1, wherein the pellet is made of a foam material.

4. The apparatus of claim 3, wherein the pellet is substantially cylindrical.

5. The apparatus of claim 1, wherein the apparatus is configured to automatically first apply solvent, then shoot the pellet upon activation of the apparatus.

6. The apparatus of claim 1 wherein the pellet-shooting portion shoots pellets based on a gas-pressure differential.

* * * * *